United States Patent [19]

Pittman et al.

[11] 4,029,568

[45] June 14, 1977

[54] METHOD OF RECOVERY OF OIL AND BITUMEN FROM OIL-SANDS AND OIL SHALE

[75] Inventors: Tobe A. Pittman, Centerville; Jack L. Woods, Ogden, both of Utah

[73] Assignee: Minerals Research Corporation, Ogden, Utah

[22] Filed: Sept. 26, 1975

[21] Appl. No.: 617,045

Related U.S. Application Data

[63] Continuation-in-part of Ser. No. 439,441, Feb. 4, 1974, abandoned.

[52] U.S. Cl. ..... 208/11 LE
[51] Int. Cl.[2] ..... C10G 1/04
[58] Field of Search ..... 208/11 LE

[56] References Cited

UNITED STATES PATENTS

| | | | |
|---|---|---|---|
| 1,514,113 | 11/1924 | Trumble | 208/11 LE |
| 2,173,842 | 9/1939 | Horner | 208/11 LE |
| 2,453,633 | 11/1948 | Logan | 208/11 LE |
| 3,050,289 | 8/1962 | Gerner | 208/11 LE |
| 3,392,105 | 7/1968 | Poettmann et al. | 208/11 LE |
| 3,856,474 | 12/1974 | Pittman et al. | 208/11 LE |
| 3,925,189 | 12/1975 | Wicks | 208/11 LE |
| 3,929,193 | 12/1975 | Duke | 208/11 LE |

OTHER PUBLICATIONS

Hawley 6.6. Ed. Condensed Chemical Dictionary 8th Ed. Van Nostrand Reinhold Co., N.Y., pp. 364, 668, 886.

*Primary Examiner*—Delbert E. Gantz
*Assistant Examiner*—James W. Hellwege

[57] ABSTRACT

A method of recovering oil and oil sands, wherein the system is operated without the need of water or in general even of heat, at least in appreciable quantities. The subject method includes providing crushed ore, crushed preferably to particulate size, on a perforate bed or support and then spraying the so-crushed oil sands ore with a selected solvent at from 1-100 psi gauge pressure such that an oil-containing solution can be collected beneath such support. Thereafter, the oil is recovered by vaporizing the solvent and thereafter condensing the solvent for re-use. Upon vaporization of the solvent, the oil and lighter fractions remain and can be introduced into a refinery or distillation column for recovering desired fractions from the recovered oil or bitumen and also for producing a separate fraction so that the same can be used as an energy source to supply the necessary heat required as well as power for the mechanical equipment used. In the process of selecting and utilizing solvents, it is preferred that methylchloroform, trichloroethylene, or perchloroethylene be used.

6 Claims, 1 Drawing Figure

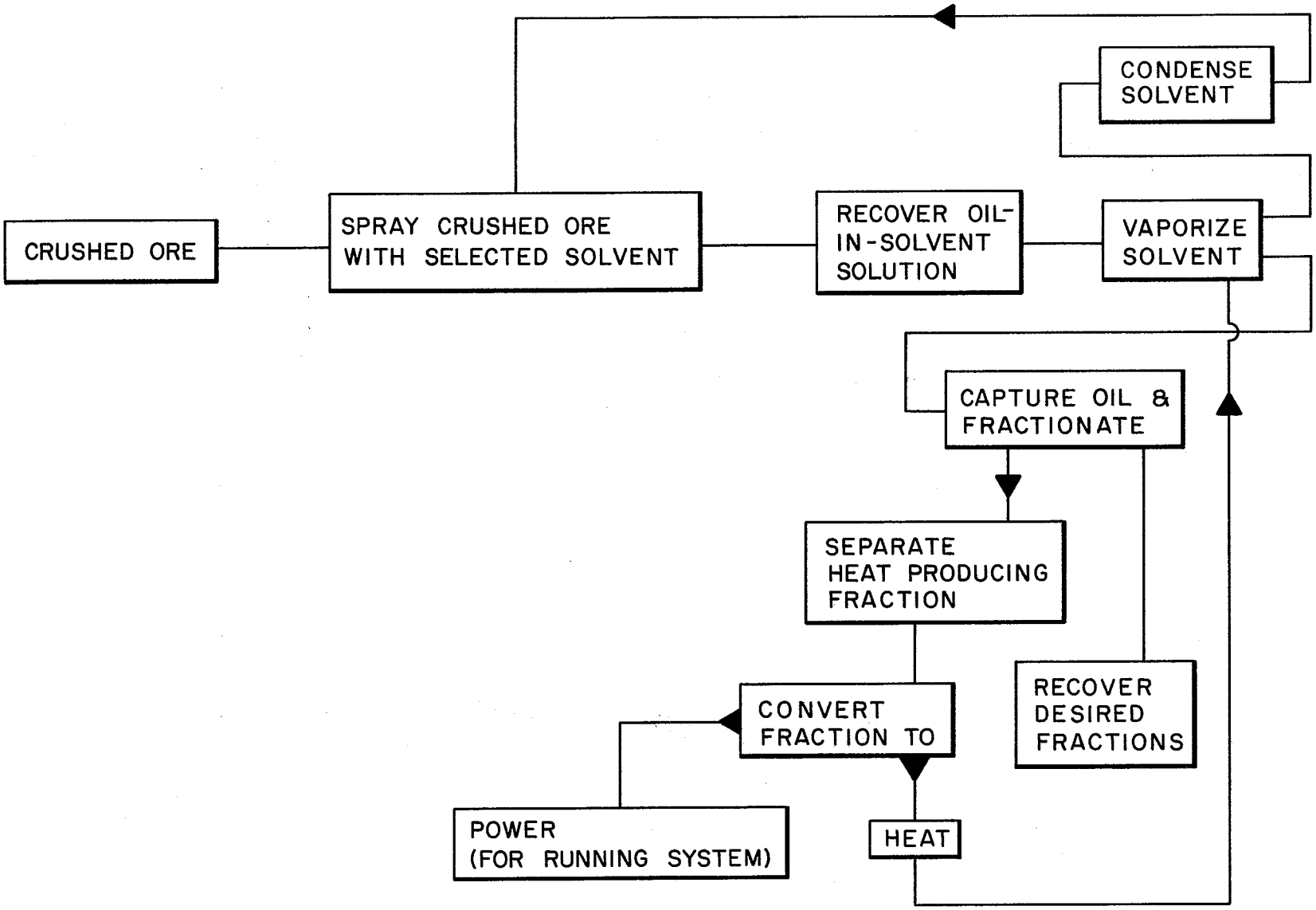
CONDENSE SOLVENT
VAPORIZE SOLVENT
CAPTURE OIL & FRACTIONATE
RECOVER DESIRED FRACTIONS
RECOVER OIL-IN-SOLVENT SOLUTION
SEPARATE HEAT PRODUCING FRACTION
CONVERT FRACTION TO
HEAT
POWER (FOR RUNNING SYSTEM)
SPRAY CRUSHED ORE WITH SELECTED SOLVENT
CRUSHED ORE

METHOD OF RECOVERY OF OIL AND BITUMEN FROM OIL-SANDS AND OIL SHALE

This is a continuation-in-part of a copending patent application by the same inventors, Ser. No. 439,441, filed Feb. 4, 1974, now abandoned and entitled "Method of Recovery of Oil and Bitumen from Oil-Sands and Oil Shale."

The present invention relates to methods of recovering oil from oil sands and, more particularly, to an improved method requiring a minimum of energy and little or no utilization of water.

Tar sands or oil sands have unique properties among bituminous ore deposits, in that the hydrocarbon bituminous material contained in oil sands is largely soluble in oil solvents without any application of heat.

In the past, many types of expensive and involved processes have been devised for processing oil sands to recover oil therefrom. U.S. Pat. No. 2,453,060 utilizes heat, water, steam, and solvents in a slurry flotation system. The process is expensive and can cause serious environmental problems, leaving polluted water and sand. U.S. Pat. No. 2,596,793 represents an expensive procedure utilizing hot methylene chloride and high pressures for extracting certain petroleum fractions from shale. Another system is described in U.S. Pat. No. 3,131,141. Temperatures are used therein in excess of 100° F. The hot tar sands are contacted with liquified, normally gaseous hydrocarbons such as propane. This is an expensive procedure not easily adaptable to large-scale production. Other patents include U.S. Pat. Nos. 3,509,037, 3,050,289, 2,453,633, 3,503,868, 1,514,113, 3,392,105, and so forth.

A number of these patents disclose batch processing. An experiment simulating the process of Pat. No. 3,392,105 indicates an extraction rate of less than 85 percent; further, the wet spent tar sands were dirty, containing both solvent and soluble oil. This is costly and is believed to create a serious pollution problem. U.S. Pat. No. 1,514,113 utilizes a closed system wherein oil sands and kerosene are mixed in a cement-mixer type arrangement. It is noted that some solvent remains with the sand, and that such must or may be blown off with steam. This confirms that the sand is, in fact, contaminated with solvent containing some petroleum. A laboratory experiment was made and asphalt ridge tar sands used. It was noted that less than 91 percent recovery was effected. The batch process in U.S. Pat. No. 3,503,868 was investigated which discloses a type of pressure cooking of tar and oil sands. The procedures similar to those described in such patent were used in asphalt ridge tar sands, with one liter of gasoline intermixed with an auto-ignition temperature of 490° F. The cooker was sealed and heated to 450° F and held at this temperature for one hour; after this time the cooker was instantly vented. The procedure was repeated five times, utilizing the initial charge of tar sands but adding one liter of new gasoline each time. After the experiment, the tar sands were analyzed and it was found that the system recovered only 27 percent of the oil available from the sands. In addition, the dirty tar sands had to be disposed of. While Patent 3,503,868 discloses solely the process for removing kerogen from oil shale, the system obviously is ineffective for sands processing.

Additionally, prior inventions have required inordinate amounts of heat for preheating materials, supplying steam or hot water solutions, retorting, and so forth.

By the present invention, and particularly by virtue of the choice of the solvents made, little if any heat is needed in accomplishing the process. However, to accelerate solvent recovery for re-use, it is permissible to use a very small amount of heat to vaporize the solvent from the recovered solution so that the solvent can indeed be re-used for spraying.

In contrast and in complete departure from the above, the subject invention involves the supporting on a perforate bed, tray, or conveyor belt a layer of particulous tar sands, and then pressure-spraying a suitable solvent or diluent through such tar sands to collect the oil and entraining solvent in a bath beneath the perforate bed used. Pressures from 1 psi to 100 psi provide a critical range of operating pressures, with 15 to 60 psi being recommended. The object in view, in operating at such pressures, is to provide a sufficient penetration so that the solvent will intimately intermix with and carry off the oil in a slightly reduced viscous form. Additionally, it was found that efficiencies increased slightly at higher pressures, tending to confirm that there is, in addition to the chemical action, an action of mechanical impaction by the spray droplets that serve to loosen the oil particles from the sand and permit the solvent to carry such oil droplets through the perforate support into the collecting bath. It has been shown through experimentation that this solvent impingement upon the oil sands actually mechanically dislodges the petroleum from the sands as well as dissolving it. Pressures above 100 psi render the process considerably less effective since the tar sands are simply blown around and pumping cost is increased. Nozzle pressure must be greater than 1 psi to gain the mechanical assist necessary in speeding the dissolving rate. Optimum spray nozzle pressures is in the range of from 15 to 60 psi, with up to 100 psi being acceptable. Pressures above 100 psi simply blow the sands about and would require a closed drum arrangement; but this would not avoid a mixing of the sands with the spray, requiring some considerable filtering or centrifuge process, unneeded in the present invention.

The particular solvents suggested have an unusually high penetrating and extraction power and solvent-recovery effect, this in addition to having low boiling points, specific heats, and heats of vaporization. Through the use of such particular solvents within the critical pressure range given, vaporization of the solvent from a recovered oil-and-solvent solution can be performed in many regions automatically and under ambient temperature conditions of the locale. Likewise, subsequent condensation of the solvent used can be had simply by circulating a coolant fluid such as a small quantity of water or other heat exchange liquid. This can be in a closed system.

The spraying utilized in the process performs a maximum recovery with a minimum of materials. Preferred hydrocarbons utilized as "solvents", namely, methylchloroform, trichloroethylene and perchloroethylene, are remarkably effective by virtue of their high solvent effect, low boiling point, low specific heat, and low heat of vaporization. Additionally, these chemicals are nonflammable.

Accordingly, a principal object of the present invention is to provide a new and improved method or process for recovering oil from oil sands or "tar sands".

A further object is to provide a bitumen oil recovery process which does not require the use of any appreciable quantity of water.

An additional object is to provide an oil recovery process, in connection with oil-sand operations, wherein selected solvents of desired characteristics are used so as to reduce if not eliminate the heat required in performing the process.

A further object is to provide a solvent spray process for treating oil sands to recover oil therefrom with a minimum of expense and with the use of little or no water, if such is desired.

The features of the present invention may best be understood by reference to the following description taken in connection with the accompanying drawing in which:

The sole FIGURE is a schematic flow sheet of the process indicating the manner in which the process is conducted.

The first step in the process is to provide crushed ore, namely, crushed oil sands. The largest sized particles should all be of the order of less than 1½ inches in diameter and, preferably, should be of particulate size a majority of which passes a minus 20 to a minus 40 screen mesh. In general, the finer the mesh and particulate size, the greater the oil recovery. The particulate size generally preferred will resemble that of conventional granulated table sugar, and it has been found that with this size the solvent spraying to follow is much more effective in washing out the bituminous matter in the core.

The so crushed and screened ore is then placed in a thin layer (¼ inch to 1½ inches) on a screen or other perforate support, such as even a perforate conveyer belt. The size of the holes or perforations in the support will of course be less than, say, at least 90 percent of the oil sands disposed thereover.

The next step will be to spray downwardly upon the crushed ore, on such support, with one or more selected solvents, at from 1 to 100 psi. This is preferably performed over a perforated conveyer belt containing a layer of the crushed ore of not greater than 1½ inches thick. Thus, the sprayed solvent impinges on the upper surface of such crushed ore and washes therethrough, and through the belt, to entrain the bituminous matter in the solvent and carry the same to an oil-solvent solution below such conveyer belt.

The types of solvent that can be used are identified as follows:

Group 1. Chlorinated hydrocarbons:
carbon tetrachloride
methylchloroform
trichloroethylene
perchloroethylene
chloroform In the entire process of selecting and utilizing solvents, it is eminently preferred that either methylchloroform, trichloroethylene or perchloroethylene of the chlorinated hydrocarbon group be used. This is because these chemicals are non-flammable, have a very low boiling point, a low specific heat, a low heat of vaporization, and a high solvent effect.

There are other groups, however, that can be employed. Thus, any of the following groups 2, 3 or 4 might be used from which a solvent can be selected:

| | |
|---|---|
| Group 2 | benzene (benzene series)<br>toluene<br>zylene |
| Group 3 | Aromatic hydrocarbons (containing 1–3 chlorine atoms)<br>monochlorobenzene<br>orthodichlorobenzene<br>trichlorobenzene |
| Group 4 | Saturated aliphatic hydrocarbons, i.e., the alkane series from:<br>pentane ($C_5 H_{12}$) through 14 carbon atoms, i.e., $C_{14} H_{30}$. |

All of the above solvents will work successfully. However, infinitely preferable, for the reasons explained, are methylchloroform, trichloroethylene and perchloroethylene. The specific heats, heats of vaporization, low boiling points and so forth of these three highly preferred chemicals are given in the standard chemical dictionaries and texts.

Numerous tests have been performed, among which the following are representative:

| Solvent | Spray Nozzle | Solvent Flow Rate | Nozzle Pressure | Percent Petroleum Recovered | Sand Condition After Extraction |
|---|---|---|---|---|---|
| Methyl Chloroform | ¼ GG12SQ | 2.0 | 30 psi | 100 | Clean |
| Methyl Chloroform | ¼ GG12SQ | 1.5 | 15 psi | 100 | Clean |
| Trichloroethylene | ¼ HH14.5SQ | 1.5 | 10 psi | 99.8 | Clean |
| Perchloroethylene | ¼ GG12SQ | 0.8 | 5 psi | 99.1 | Almost Clean |
| Perchloroethylene | ¼ VV9508 | 0.3 | 2 to 3 psi | 98.9 | Almost Clean |
| Chloroform | ¼ HH14.5SQ | 3.1 | 60 psi | 100 | Clean |
| Hexane | ¼ VV11015 | 0.6 | 5 psi | 99.0 | Almost Clean |
| Hexane | ¼ HH14.5SQ | 1.7 | 14 psi | 99.9 | Clean |
| Toluene | ¼ VV11015 | 1.9 | 60 psi | 100 | Clean |
| Xylene | ¼ VV11015 | 1.0 | 20 psi | 100 | Clean |
| Methyl Chloroform | ¼ GG12SQ | 0.5 | 1 to 2 psi | 99.1 | Almost Clean |
| Ortho-Dichlorobenzene | ¼ VV9508 | 0.7 | 30 psi | 99.8 | Clean |
| Methyl Chloroform | ¼ GG12SQ | 2.6 | 60 psi | 100 | Clean |
| Monochlorobenzene | ¼ GG12SQ | 2.2 | 40 psi | 100 | Clean |

Where:

1. The solvent temperature was ambient and varied between 74° and 83° F.

2. Spray nozzles were obtained from the Spraying Systems Company, Wheaton, Illinois 60187.

3. The flow rate given above is in gallons per minute.

4. GG and HH nozzles spray a solid square pattern. The VV nozzles spray a flat pattern. The stainless steel screen used was held stationary under the GG and HH nozzles and gradually moved under the VV nozzles so that the complete bed of tar sands was contacted by the spraying solvent.

After studying the data, it became obvious that the type of nozzle had very little or no effect on the extraction process. Nozzle pressure, however, does affect percent extraction since the solvent impingement mechanically dislodges the petroleum as well as dissolves it, permitting the oil to pass with the solvent through the perforate support supporting the sand. In order to insure that there is a high percentage of petroleum extraction and that therefore the spraying solvent contact essentially all of the crushed tar or oil sands, it is recommended that the bed of sand disposed on the perforate supporting bed be not less than ⅛ inch nor more than ⅜ inch thick. Such a sand bed thickness, however, should not be looked upon as a limitation herein, since the bed may vary somewhat from the range given, e.g. see page 7.

Solvent flow rate is of some importance since the ratio of solvent to petroleum affects the dissolving rate. From a practical viewpoint the solvent flow rate should be somewhere in the range of one to three gallons per minute per square foot of tar sands for a bed ⅛ inch to ⅜ inch thick.

Accordingly, in the invention the advantage of spraying is that there is a fast removal of oil from the sands, both chemically and by virtue of mechanical impingement and, secondly, the sands are supported by its perforate bed so that there is an automatic separation of the spent sands from the collected liquid.

It is noted that there is no water necessary or present in the recovered oil-solvent solution.

The oil-containing solvent is, of course, in solution form, and, hence, the next step will be to vaporize the solvent contained in the solution. This can be done in an extremely low heat environment, the heat applied being dependent upon the solvent being used. Certain ones of the solvents are vaporized readily at normal ambient temperatures and hence, it is possible that no heat will be necessary whatever for summer desert environments.

Once the solvent is vaporized and, hence, separated from the solution, then the solvent need only be condensed and re-used in connection with the spray step. Such condensation may be performed by a simple water-coolant, by way of example, in a closed refrigeration system.

The residue of the solution, namely, the oil which has been captured, is then simply fractionated in a refinery or distillation column to recover desired hydrocarbon fractions and also to separate out the heat-producing fraction, namely, the bottoms, or those fractions in the heavier fuel-oil region.

That fraction of the recovery which is made available for heat can be actually used to produce heat, as by a burner, for vaporizing the solvent where such is needed, and this depending upon the particular solvent selected. The remainder of that same fraction may be converted, as to energy form, by a steam generator and turbine for producing electric power to run conveyer belts, pumps, and perform other useful objects as needed.

It cannot be over-emphasized that the preferred selection of either methylchloroform, trichloroethylene, or perchloroethylene as a solvent to be used in the process materially solves a number of problems. Thus, not only is there a high extraction recovery of the oil contained within the oil sand, but also the characteristics of low boiling point, low specific heat, and low heat of vaporization insures that neither water nor heat are really necessary in the operation for most locales. Indeed, for environments above 65° F, conceivably no additional heat whatever will be required where the three above-named preferred solvents are used; and tap water or stream water could be used to effect the necessary condensation step. In the case of cold-temperature climates, a very minimum of heat is required to vaporize the solvent from the solution in order to re-use the solvent and recover the oil or bitumen collected. Whether these solvents, especially, are used, then it is highly recommended that the spraying and collection steps be in essentially completely enclosed systems, this to minimize solvent loss through vaporization to the exterior.

It is noted that by virtue of the spray treatment of the crushed oil sands, in lieu of any solvent tank or batch system, that a continuous throughput is rendered possible and minimizes the mechanical steps that need to be taken to effect oil recovery.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

We claim:

1. A process for recovering bitumenous organic matter from tar sands, comprising the steps of supplying a layer of crushed ore containing tar sands on a perforate support, spraying such ore with a bitumen solvent from a class consisting of methylchloroform and chloroform, said spraying step being conducted at a pressure of from 1 to 100 psi to recover bitumen therefrom beneath said perforate support, whereby to form a solvent-bitumen solution which is essentially free of water, collecting said solution, vaporizing said solvent of said solution to leave a bitumen residue as a usable product, and condensing the so vaporized solvent for re-use in said spraying step.

2. The process of claim 1 wherein there is included the additional step of fractionating said recovered residue to produce usable end products and a heat-producing fuel fraction, and then converting the energy of said fuel fraction to vaporize said solvent.

3. The process of claim 1 wherein there is included the additional step of fractionating said recovered residue to produce usable end products and a heat-producing fuel fraction converting the energy of said fuel fraction to heat, and applying said heat to said solution to vaporize and subsequently condense said solvent of said solution for re-use in said spraying step.

4. The process of claim 1 wherein there is included the additional step of heating said ore prior to spraying thereof.

5. The process of claim 1 wherein, in the step of supplying crushed ore, said ore is crushed such that a majority thereof passes through a minus twenty mesh screen.

6. A process for recovering oil from tar sands comprising the steps of supplying a perforated-bed supported layer of crushed ore containing tar sands, spraying downwardly onto and through such ore with a bitumen solvent, from a class consisting of methylchloroform and chloroform, at from 1 to 100 psi to recover separated bitumen therefrom beneath such ore and perforated bed, to form a solvent-bitumen solution which is essentially free of water, collecting said solution, vaporizing said solvents to leave a bitumen residue as a usable product, and condensing the so vaporized solvent for re-use in said spraying step.

* * * * *

UNITED STATES PATENT OFFICE

CERTIFICATE OF CORRECTION

Patent No. 4,029,568 Dated June 14, 1977

Inventor(s) TOBE A. PITTMAN AND JACK L. WOODS

It is certified that error appears in the above-identified patent and that said Letters Patent are hereby corrected as shown below:

[57] ABSTRACT line 1, change "and" to --from--;

Column 1, line 23, change "represents" to --presents--;

Column 3, line 28, change "core" to --ore--;

Column 5, line 9, delete "e.g. see page 7".

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*